US008746729B2

(12) United States Patent
Convert

(10) Patent No.: US 8,746,729 B2
(45) Date of Patent: Jun. 10, 2014

(54) TOE PIECE FOR GLIDING APPARATUS AND GLIDING APPARATUS EQUIPPED WITH SUCH BINDING

(71) Applicant: Salomon S.A.S., Metz-Tessy (FR)

(72) Inventor: François Convert, Meythet (FR)

(73) Assignee: Salomon S.A.S., Metz-Tessy (FR)

( * ) Notice: Subject to any disclaimer, the term of this patent is extended or adjusted under 35 U.S.C. 154(b) by 0 days.

(21) Appl. No.: 14/058,905

(22) Filed: Oct. 21, 2013

(65) Prior Publication Data

US 2014/0110919 A1 Apr. 24, 2014

(30) Foreign Application Priority Data

Oct. 22, 2012 (FR) ..... 12 02814

(51) Int. Cl.
*A63C 9/00* (2012.01)

(52) U.S. Cl.
USPC ..... 280/616; 280/615; 280/613

(58) Field of Classification Search
USPC ..... 280/611–637
See application file for complete search history.

(56) References Cited

U.S. PATENT DOCUMENTS

| | | | | |
|---|---|---|---|---|
| 4,035,001 | A * | 7/1977 | Jungkind | 280/626 |
| 4,479,664 | A * | 10/1984 | Gertsch | 280/618 |
| 5,016,902 | A * | 5/1991 | Goud et al. | 280/630 |
| 5,577,757 | A * | 11/1996 | Riepl et al. | 280/624 |
| 6,092,831 | A * | 7/2000 | Bauvois | 280/625 |
| 8,439,389 | B2 | 5/2013 | Moore et al. | |
| 8,544,869 | B2 * | 10/2013 | Lehner | 280/611 |
| 2008/0184599 | A1 * | 8/2008 | Ekberg | 36/117.3 |

FOREIGN PATENT DOCUMENTS

| | | | |
|---|---|---|---|
| DE | 32 27 237 | C1 | 1/1984 |
| EP | 0 199 098 | B1 | 2/1990 |
| EP | 2 300 111 | | 10/2009 |
| EP | 2 353 673 | A1 | 8/2011 |
| EP | 2 392 388 | A1 | 12/2011 |
| WO | WO-2009/121187 | A1 | 10/2009 |

* cited by examiner

*Primary Examiner* — John Walters
*Assistant Examiner* — James Triggs
(74) *Attorney, Agent, or Firm* — Greenblum & Bernstein, P.L.C.

(57) ABSTRACT

A toe piece for a gliding apparatus, such as a touring ski, including two tightening elements relatively movable between a boot-tightened position, in which they engage respective lateral housings of the boot, and an open position to release the boot, the tightening elements forming a pivot axis for the boot and a stop movable between an active position in which the stop comes into contact with the front end of the boot so as to longitudinally position the lateral housings of the boot, and a retracted position in which the stop does not interfere with normal pivoting of the boot during an ascent phase, the stop being in an active position when the two tightening elements are in the open position and the movable stop is directly connected to the tightening elements, so that a relative displacement of the tightening elements causes the stop to switch between its active and retracted positions.

16 Claims, 4 Drawing Sheets

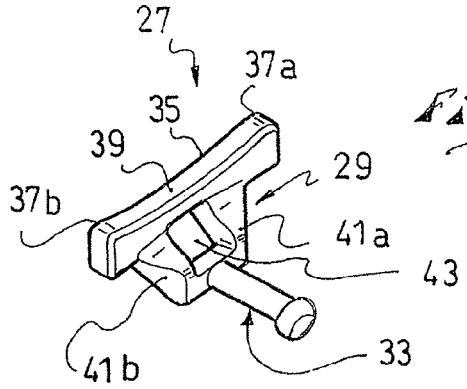
Fig: 3
Fig: 4
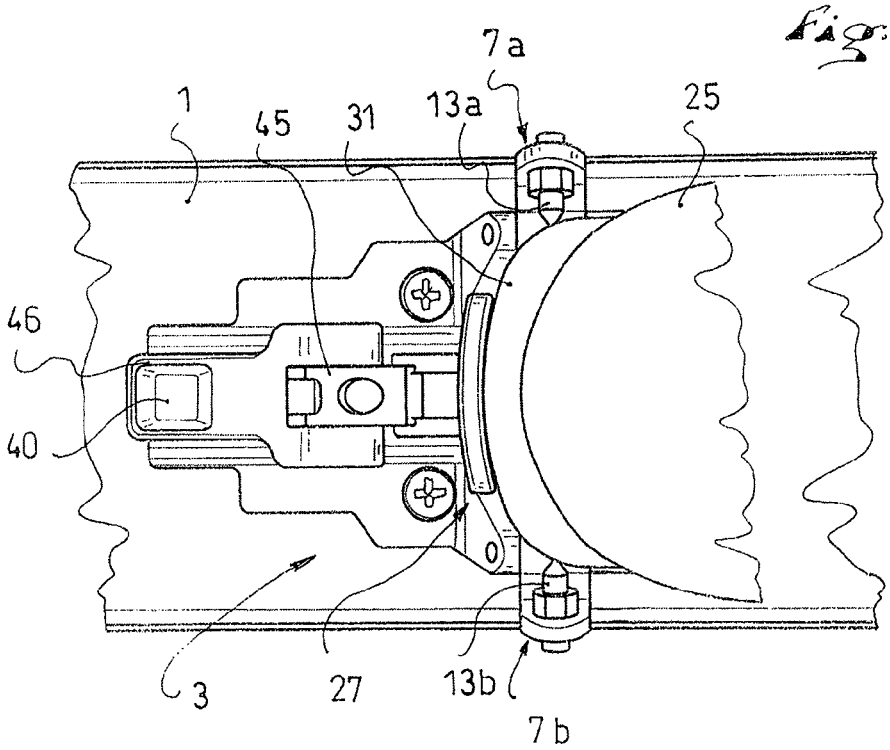

TOE PIECE FOR GLIDING APPARATUS AND GLIDING APPARATUS EQUIPPED WITH SUCH BINDING

CROSS-REFERENCE TO RELATED APPLICATION

This application is based upon French patent application Ser. No. 12/02814, filed Oct. 22, 2012, the disclosure of which is hereby incorporated by reference thereto in its entirety, and the priority of which is claimed under 35 U.S.C. §119.

BACKGROUND

1. Field of the Invention

The present invention relates to bindings for a gliding apparatus, in particular a toe piece for a touring ski and a gliding apparatus equipped with such a binding. The gliding apparatus can be a ski or a snowshoe, for example.

2. Background Information

Ski touring is an increasingly popular sporting activity and attracts a growing number of enthusiasts.

Ski touring involves climbing a mountain using touring skis. During the ascent phase, the skis are equipped with "sealskin" made of a synthetic material that prevents the skis from moving backwards. Moreover, these skis have a special binding device comprising a toe piece enabling the touring ski boots to pivot about a transverse axis located at the forefoot. This rotation enables the heel of the user to move away from the ski in order to exert an optimal thrust force during the ascent.

The document EP-0 199 098-B1 describes a touring ski binding whose toe piece includes two L-shaped tightening levers, each of which articulates about a longitudinal axis. These arms include tightening lugs adapted to cooperate with a touring ski boot. The two tightening levers are articulated by a spring-loaded mechanism in order to occupy two stable positions. A first stable position, so-called tightening position, corresponds to a configuration in which the tightening lugs cooperate with corresponding recessed portions arranged laterally in the front portion of the touring ski boot. This cooperation makes it possible to attach the boot by allowing only a rotational movement about an axis transverse to the ski. A second stable position, so-called open position, corresponds to a configuration in which the tightening levers are spaced apart so that the tightening lugs release the boot, which can then be separated from the touring ski.

Binding the front portion of the touring ski boot on a touring ski equipped with such a toe piece is carried out as follows. In a first step, the boot is positioned while the two tightening levers of the toe piece are spaced apart, in the open position. In a second step, strong pressure is exerted on the spring-loaded mechanism, using the front of the boot sole. This action on the mechanism enables the tightening levers to switch to their tightening position. The boot is then fixed to the toe piece because, in this position, the tightening lugs are housed in the corresponding recessed portions of the boot.

However, a skier quickly finds it difficult to engage the ski boots in these bindings. Indeed, it is necessary to present the boot with its recessed portions facing the lugs with a certain precision, which is not easy due, in particular, to the size of the ski boots, on the one hand, and the small size of the lugs of the toe piece and of the corresponding recessed housings of the boot, on the other hand.

A first solution has been provided by the document EP-1 559 457-B1, which describes an alternative to the previous solution, in which the boot has a groove beneath its connecting lateral recessed portions, whose function is to guide the boot when it is positioned in the vicinity of the tightening lug of the toe piece of the ski. The tightening lugs are thus guided within the grooves of the boot until facing the recessed portions provided for binding the boot.

Although this solution enables the boot to be engaged with a slight longitudinal offset of the sole, the binding still requires a relatively precise longitudinal positioning of the boot. This toe piece provides no assistance to the boot insertion.

Other known designs involve providing toe units, which may or may not be retractable, adapted to cooperate with the front of the boot in order to position the boot longitudinally in a relatively precise manner. Such toe units are described in the documents EP-2 392 388-A1, U.S. Pat. No. 8,544,869-B2, EP-2 300 111-A1, and U.S. Pat. No. 8,439,389-B2.

However, the design of these toe pieces has proven to be complex. The proposed retractable toe pieces pivot about a transverse axis located in front of the tightening levers. In one case, the retraction of the toe piece is directly associated with a locking lever. In another case, the retraction is carried out by the longitudinal translation of the toe piece. In a third case, the toe piece is not retractable. In the latter case, the solution includes two fixed lateral stops that are small in size so as not to hinder the rotation of the boot when it is in engagement with the toe piece. These lateral stops are not very efficient because they act on small contact zones. They are even less efficient when the ski is banked.

SUMMARY

The present invention at least partially overcomes the aforementioned disadvantages by providing a toe piece for a touring ski for easier engagement of the ski boot. The invention also provides a very simple design of retractable toe piece.

To this end, the invention provides a toe piece for a gliding apparatus, such toe piece comprising two opposite tightening elements each carrying a tightening lug at one end, both tightening elements being movable in relation to one another, between a position for tightening a front end of a boot, in which the tightening lugs are brought closer together so as to cooperate with lateral corresponding housings provided directly or indirectly in the boot in order to form a pivot axis for the boot, and an open position in which the tightening lugs are spaced apart so as to release the boot from the tightening elements. The toe piece also comprises a stop movable between an active position in which the movable stop is adapted to come into contact with a portion of the front end of the boot in order to longitudinally position the lateral housings of the boot substantially in the area of the tightening lugs, and a retracted position in which the movable stop is positioned so as not to disturb the normal pivoting of the boot in the ascent phase, the movable stop being in an active position when the two tightening elements are in an open position.

The movable stop of the toe piece is directly connected to the tightening elements, so that a relative movement between the tightening elements causes the movable stop to switch between its active position and its retracted position.

Thus, the touring ski boot can more easily be positioned prior to being inserted into the binding.

The binding according to the invention can comprise one or more of the following features, taken alone or in combination:

- the movable stop moves along a substantially vertical direction;

the active position of the movable stop is a raised position, and the retracted position of the movable stop is a lowered position;

each tightening element forms a lever that is pivotally articulated about a longitudinal axis, each tightening element comprising an end in contact with the movable stop;

the movable stop is affixed to a bi-stable elastic mechanism for switching the two tightening elements between the tightening position and the open position;

the mobile stop is affixed to a central articulation forming an element of the bi-stable elastic mechanism, the central articulation connecting an end of one tightening element to an end of the other tightening element;

the movable stop comprises an upright portion adapted to come into contact, in the active position, with a portion of the front end of the boot, and a horizontally recumbent portion affixed to the central articulation of the bi-stable mechanism;

the upright portion of the movable stop has a transverse bar at its free end, such transverse bar having a concave shape on its upper face, between its ends;

the cross bar is carried by two flanges defining a slot for passage of a control lever in engagement with the bi-stable elastic mechanism;

the toe piece comprises an actuating lever, one end of which forms a fork in which a portion of the movable stop is housed;

the toe piece locking comprises a locking mechanism for locking a lever for actuating the tightening elements;

the toe piece comprises an elastic mechanism for maintaining the locking mechanism in a configuration for locking the actuating lever, when the lugs are in the tightening position;

the movable stop is arranged so that, in the active position, the movable stop positions the ski boot such that the pivot axis of the ski boot, defined by the housings, is positioned with an offset, such as between 1.0 and 4.0 mm, slightly before the axis defined by the tightening lugs in the tightening position;

the movable stop comprises a removable wedge positioned so as to be interposed between the movable stop and the portion of the front end of the boot.

The invention further relates to a touring ski equipped with a binding such as described above.

BRIEF DESCRIPTION OF DRAWINGS

Other advantages and characteristics will become apparent from reading the description of the invention, and from the following drawing figures, in which:

FIG. 3 shows a perspective view of a constituent element of the toe piece for a touring ski;

FIG. 4 is a top view of the toe piece for a touring ski according to the invention, in the open position with a ski boot during engagement of the ski boot;

DETAILED DESCRIPTION

Figure 1:
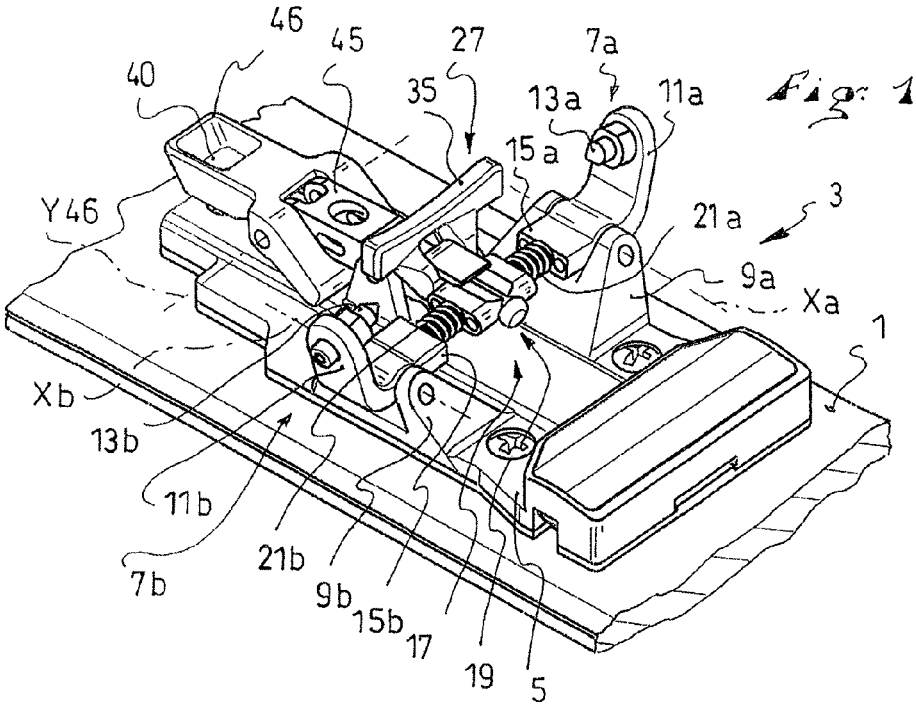
FIG. 1 is a perspective view of a portion of a touring ski equipped with a toe piece for a touring ski according to the invention, in the open position.

The same elements are designated by the same reference numerals in all of the drawing figures.

In the following description, reference will be made to terms such as "horizontal", "vertical", "longitudinal", "transverse", "upper", "lower", "top", "bottom", "front", and "rear". These terms should be considered as relative with respect to the normal position which the retaining device occupies on a ski, and the normal advance direction of the ski. In addition, the term "upright" is used to describe elements which, when mounted on a ski, extend upward in relation to the ski. These elements are then oriented substantially vertically. Similarly, the term "recumbent" is used for element which, when mounted on a ski, extend substantially in a plane parallel to ski. These elements are then oriented substantially horizontally. For example, "longitudinal" refers to a direction along the longitudinal axis of the ski, or along vertical plane containing such axis.

FIG. 1 shows a front portion of a touring ski 1 provided with a binding including a touring toe piece 3.

The toe piece 3 comprises a base 5 in the form of a plate which is fixed, for example, by screwing onto the top of the ski 1, on the one hand, and two tightening elements 7*a* and 7*b*, hereinafter referred to as the tightening levers, generally L-shaped and opposite one another, pivotally articulated on associated projecting bearings 9*a* and 9*b*, on the other hand. Each tightening lever 7*a* and 7*b* rotates about a substantially longitudinal articulation axis Xa, Xb. This articulation axis Xa, Xb passes through the junction of two arms 11*a*/15*a*, 11*b*/15*b* of the tightening lever 7*a*, 7*b*. The two articulation axes Xa, Xb are arranged at equal distance on both sides of a longitudinal vertical median plane of the ski.

In the area of one upright end of a first arm 11*a* and 11*b*, each tightening lever 7*a*, 7*b* carries a respective tightening lug 13*a*, 13*b*.

Figure 2:
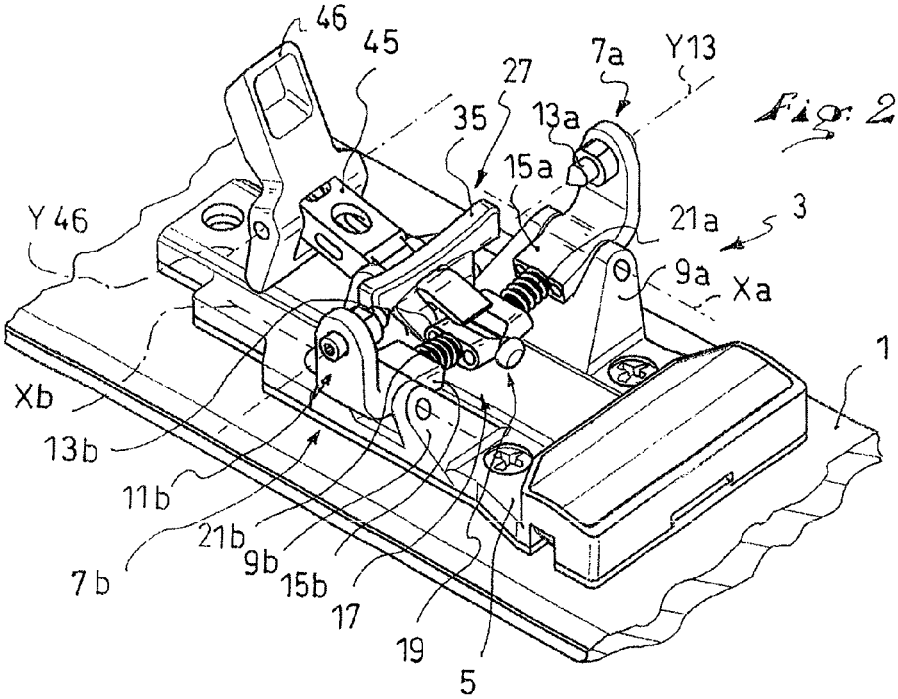
FIG. 2 shows a view identical to that of FIG. 1, with the toe piece for a touring ski in the tightening position.

Pivoting the tightening levers 7*a* and 7*b* enables a movement of the lugs 13*a* and 13*b* along a direction substantially transverse to the ski 1, between an open position, illustrated in FIG. 1, and a tightening position, shown in FIG. 2. In the open position, the lugs 13*a*, 13*b* are spaced apart, thereby releasing a boot 25. In the tightening position, the lugs 13*a*, 13*b* are brought closer together so that they can cooperate with complementarily shaped lateral housings 23*a*, 23*b*, provided on the front of the boot 25. In the latter case, the boot 25 is retained by the toe piece 3.

The two tightening levers 7*a* and 7*b* are connected to one another in the area of their second recumbent arms 15*a* and 15*b* by a bi-stable elastic mechanism 17, between the open and tightening positions. This bi-stable elastic mechanism 17 includes a central articulation 19 and springs 21*a* and 21*b* carried by the recumbent arms 15*a* and 15*b* and in support against the central articulation 19. The central articulation 19 is formed by a pivot shaft 33 about which two pads 18*a*, 18*b* turn. Each pad 18*a*, 18*b* is slidably mounted with respect to a shaft 16*a*, 16*b* fixed in the extension of a recumbent arm 15*a* and 15*b*. In a particular embodiment, the shafts 16*a*, 16*b* are not circular in cross section, so that the pads 18*a*, 18*b* can only translate along the shafts 16*a*, 16*b*. Thus, any rotation of the central articulation 19 about a transverse axis is prevented. To limit this forward or rearward tilting, each pad 18*a*, 18*b* can alternatively be connected to a recumbent arm 15*a*, 15*b* by a plurality of shafts offset along a longitudinal direction. The undesired rotation about an axis extending along a recumbent arm 15*a*, 15*b* is avoided.

In the context of the invention, a tightening lever 7*a*, 7*b*, or tightening element, in this embodiment, comprises an upright arm 11*a*, 11*b* equipped with a tightening lug 13*a*, 13*b*, and a recumbent arm 15*a*, 15*b*. The recumbent arm 15*a*, 15*b* incorporates a portion of the bi-stable elastic mechanism 17, namely, a shaft 16*a*, 16*b*, a spring 21*a*, 21*b*, and a pad 18*a*, 18*b*. Thus, for this embodiment, a pad 18*a*, 18*b* constitutes the end of a recumbent arm 15*a*, 15*b* of a tightening lever 7*a*, 7*b*.

It is therefore understandable that due to the springs 21*a* and 21*b* and the central articulation 19, the lugs 13*a* and 13*b* can take only two stable positions; the open position in which the lugs 7*a* and 7*b* are spaced apart, away from one another (FIG. 1), and a tightening position in which the lugs 13*a* and 13*b* are brought closer to one another (FIG. 2).

During the ascent, the tightening lugs 13*a* and 13*b* are housed in the corresponding lateral housing 23*a* and 23*b* provided on the front of the boot 25 to form a pivot axis for the front of the boot for the ascent. During the ascent phase, the boot pivots successively between a substantially horizontal position of the sole and a substantially vertical position of the sole. The pivot angle is variable and dependent upon the inclination of the slope to be climbed. The normal pivoting of the boot during the ascent phase is on the order of 90° in relation to the upper surface of the ski, from a horizontal reference to a vertical reference.

To facilitate the engagement of the ski boot 25 in the touring toe piece 3, the toe piece further comprises at least one movable stop 27. In FIG. 3, this movable stop 27 is shown in perspective as a single element.

As shown in all of the drawing figures, the movable stop 27, according to the present exemplary embodiment, is affixed to the bi-stable elastic mechanism 17 connecting the recumbent arm 15*a* and 15*b* of the two tightening levers 7*a* and 7*b*.

More specifically, the movable stop 27 is affixed to the central articulation 19 of the bi-stable elastic mechanism 17.

To this end, the movable stop 27 comprises an upright portion 29 and a recumbent portion 33. The upright portion 29 is adapted to come into contact, when the lugs are in the open position, with a portion of the front end 31 of the ski boot 25. The upright portion 29 is positioned in relation to the recumbent portion 33 so that, when the front end 31 of the boot reaches the upright portion, the lateral housings 23*a* and 23*b* of the boot are positioned substantially longitudinally in the same area as the tightening lugs 13*a* and 13*b*. The recumbent portion 33 forms the pivot shaft of the central articulation 19 of the bi-stable mechanism 17.

The upright portion 29 of the movable stop 27 has a transverse bar 35 at its free end. In order not to interfere with the pivoting movement of the ski boot 25 during the ascent, the upper surface of the transverse bar 35 advantageously has, between its ends 37*a* and 37*b*, a central recess 39 that may have a concave shape to receive the exterior of the boot when pivoting. Therefore, in a vertical plane, the central portion is lower than the ends 37*a* and 37*b* of the transverse bar 35. Furthermore, the transverse bar 35 is carried by two flanges 41*a* and 41*b* defining a slot 43 for passage of an actuating lever 45.

The actuating lever 45 is pivotally articulated about a transverse axis Y45, on an associated projecting bearing 48. The transverse axis Y45 is positioned in front of the tightening levers 7*a*, 7*b*. The actuating lever 45 is substantially rectilinear.

A first end 451 of the actuating lever 45 forms a fork in which the central articulation 19 is housed, so that a vertical movement of the fork 451 causes the vertical movement of the central articulation 19. Consequently, an action on a second end 452 of the lever 45 enables the central articulation 19 to be raised or lowered. Due to this lever, a substantial force can be exerted in order to switch the bi-stable mechanism 17 from one stable position to the other. In practice, the lever is used to lift the central articulation 19 in order to switch from a tightening position to an open position allowing the release of the ski boot 25 from the toe piece 3. Indeed, the shift into the tightening position is carried out by simply pressing the front of the boot on the central articulation 19.

A second end 452 of the actuating lever 45 supports a locking lever 46. This locking lever 46 is pivotally articulated about a transverse axis Y46, on a through shaft 44 affixed to the second end 452. A torsion spring 42 surrounds the through shaft 44 to connect a first arm 461 of the locking lever 46 to the actuating lever 45. The torsion spring 42 makes it possible to maintain the locking lever 46 in a configuration for locking the actuating lever 45, when the lugs are in the tightening position.

For this tightening position, the central articulation 19 is lowered, thereby lifting the second end 452 of the actuating lever 45. Thus, the torsion spring 42 exerts a force on the first arm 461 of the locking lever 46, causing the rotation of the arms of the lever up to a stop affixed to the actuating lever 45 and, consequently, the spacing of a second arm 462 of the locking lever 46 away from the actuating lever 45.

In this locked configuration, the second arm 462 extends substantially vertically, oriented slightly forward, so that if the second end 452 of the actuating lever 45 is lowered directly, the free end of the second arm 462 of the locking lever 46 comes rapidly into contact with the base 5, thereby blocking further lowering of the second end 452 of the actuating lever 45. The toe piece 3 is then locked. The lugs are maintained in the tightening position.

To unlock the toe piece, it is necessary to act on the first arm 461 of the locking lever 46. Exerting a force on this arm 461 initially causes the rotation of the second arm 462 of the locking lever 46 up to a stop affixed to the actuating lever 45. This displacement of the arm 462 makes it possible to release the actuating lever 45. The further exertion of force on the arm 461 in the same direction then causes the lowering of the second end 452 of the lever 45. This lowering makes it possible to lift the central articulation 19, which results in the spacing apart of the tightening lugs which switch to the open position. The boot is then released from the toe piece.

To facilitate the unlocking operation, the free end of the first arm 461 of the locking lever 46 includes a recess 40, facing upwards, adapted to receive the tip of a ski pole. The skier can thus disengage the boot simply by pressing with the pole on the locking lever 46.

Figure 5:
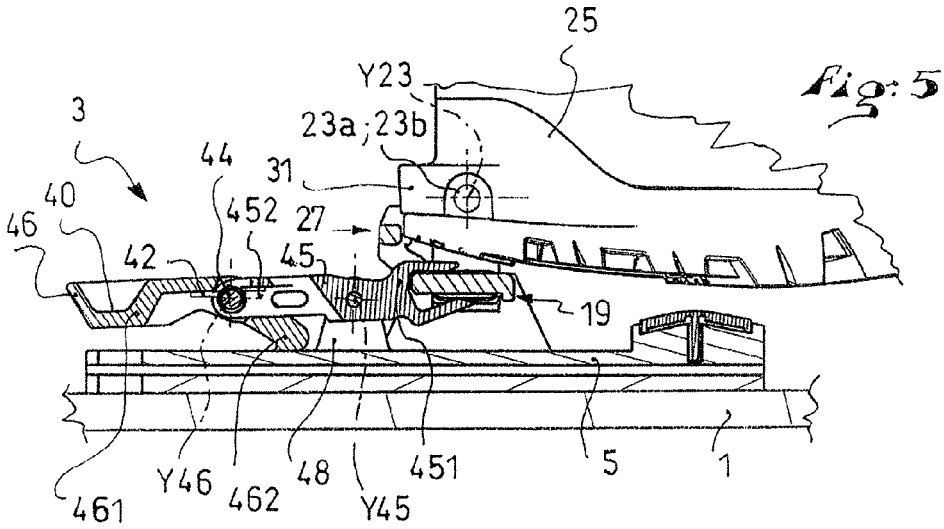
FIG. 5 is a longitudinal cross-sectional view of a touring ski equipped with a toe piece for a touring ski according to the invention, in the open position with a ski boot, uncut, during engagement of the ski boot.
Figure 6:
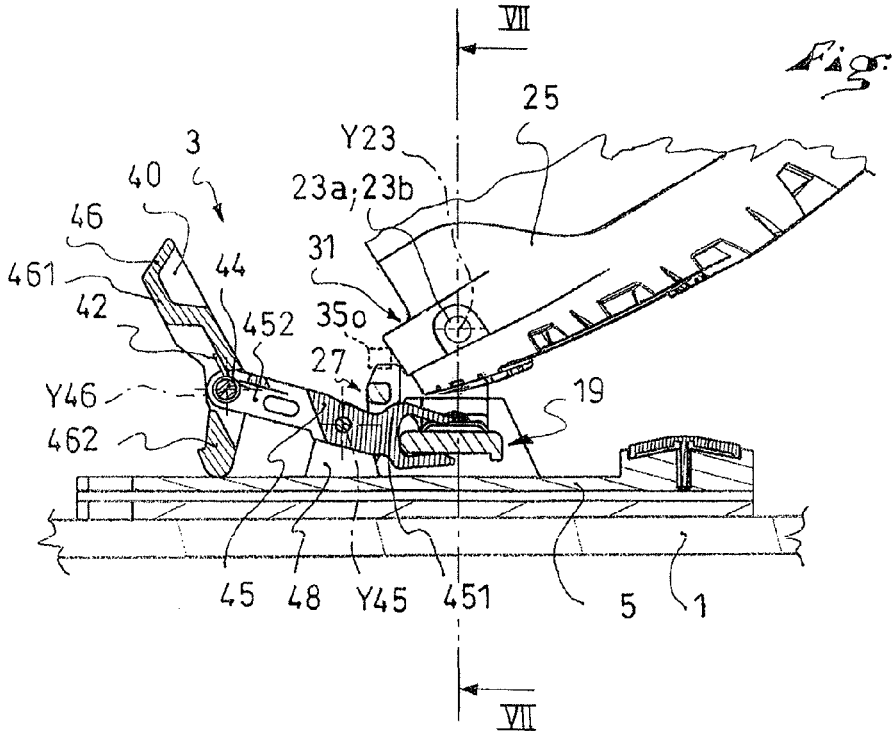
FIG. 6 is a longitudinal cross-sectional view of a touring ski equipped with a to-piece for a touring ski according to the invention, in the tightening position with a ski boot, uncut, during an upward movement.
Figure 7:
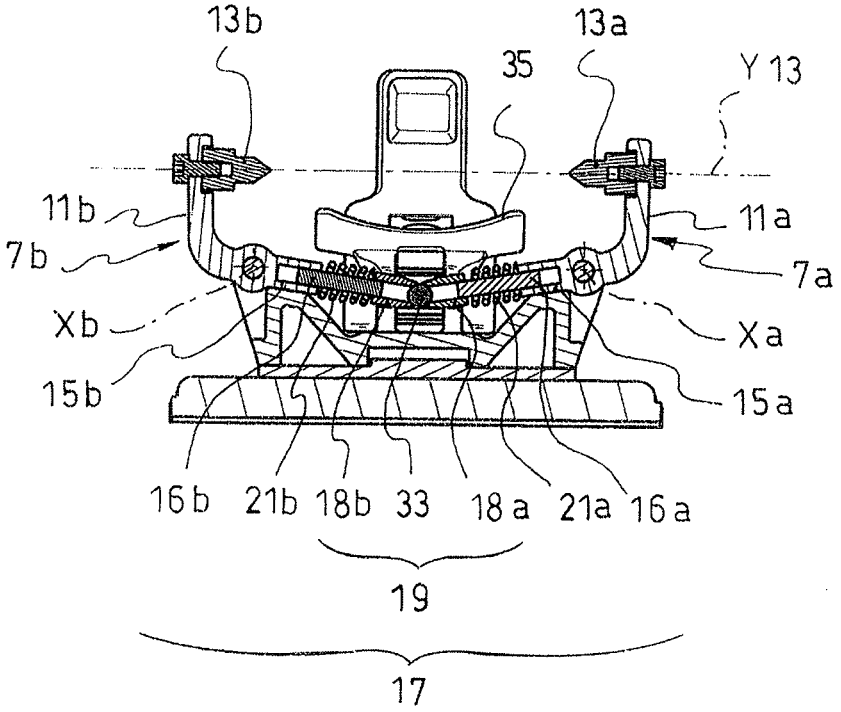
FIG. 7 is a cross-sectional view along the line of FIG. 6, without the ski boot.

With such a construction, it is understandable that the movable stop 27, and more particularly the transverse bar 35, is movable between an active position (shown in FIGS. 1, 4, and 5) and a retracted position (shown in FIGS. 2, 6, and 7).

As shown clearly in FIGS. 4 and 5, the movable stop 27, when in the active position, that is to say a raised position in this example, serves as a reference for the longitudinal positioning of a portion of the front end 31 of the ski boot 25, as described above. In the retracted position, that is to say a lowered position in the present example, the movable stop 27 is spaced from the path of the end of the ski boot 25 during pivoting movements in the ascent phase, in order not to hinder the rotation.

It is therefore to be understood that the displacement of the movable stop 27 between its active position and its retracted position is initiated by the two tightening levers 7*a* and 7*b* tilting into the tightening position.

Advantageously, the position of the movable stop 27, when active, positions the ski boot 25 so that the pivot axis Y23 of the ski boot 25, defined by the housings 23*a* and 23*b*, is positioned with an offset of an amount, in a particular embodiment, between 1.0 and 4.0 mm, slightly before the axis Y7 defined by the tightening lugs 13*a* and 13*b* in the tightening position. This forward boot positioning offset makes it possible to move the ski boot 25 backward when the tightening levers 7*a* and 7*b* tilt into the tightening position. This backward movement increases the clearance or spacing of the movable stop 27 from the front end 31 of the ski boot 25 in the tightening position. This spacing contributes to the retraction of the movable stop in order not to interfere with the pivoting of the boot. Indeed, the farther the movable stop is from the front of the boot, the less there is a risk of interference between these elements during the rotation of the boot.

The operation of the toe piece 3 according to the invention is described in more detail below, with particular reference to FIGS. 4, 5, and 6.

Initially, the toe piece 3 of the touring ski is in the open position. The tightening lugs 13*a* and 13*b* are spaced apart. The movable stop 27 is raised.

To engage the toe piece 3, the boot 25 is positioned so that its front end 31 presses longitudinally against the movable stop 27, which is easily achievable because of its size and its central position. This makes it possible to position the lugs 13*a* and 13*b* opposite the housings 23*a* and 23*b*, possibly with a small forward offset "d", as explained above. Then, it suffices to press with the front of the sole on the bi-stable elastic mechanism 17 and, more particularly, in the area of the central articulation 19. This pressure must be sufficient to overcome the force of the bi-stable elastic mechanism 17. This force makes it possible to lower the central articulation 19 in order to switch the bi-stable elastic mechanism 17 into its second stable position. Consequently, this movement enables the stable engagement of the tightening lugs 13*a* and 13*b* in the housings 23*a* and 23*b*. The boot is then held by the toe piece.

In this embodiment, the lowering of the central articulation 19 simultaneously causes the locking of the actuating lever 45, due to the torsion spring 42 acting on the locking lever 46.

Because the movable stop 27 is affixed to the central articulation 19, the lowering of the central articulation 19 causes the lowering of the movable stop 27. In addition, this affixing makes it possible to maximize the range of displacement of the movable stop 27, as the central articulation 19 is located at the end of the arms 15*a*, 15*b* of the tightening levers 7*a*, 7*b*. In other words, the central articulation 19 is located on a portion of the tightening levers 7*a*, 7*b* that is the farthest from the articulation axes Xa, Xb. Thus, the pivoting of a lever results in a maximum range of displacement at the ends of the lever. This is the case for the central articulation 19 with such a construction.

In this embodiment, the movable stop is retracted by a substantially vertical movement. By "substantially vertical" is meant that the movement of the stop follows a path of more or less thirty degrees in relation to a direction perpendicular to the upper surface of the ski.

Thus, the movable stop 27 is completely cleared off the passage of the ski boot 25 during pivoting movements in the ascent phase. To illustrate this clearance, FIG. 6 shows, via a square 35*o*, shown in broken lines, the location of the median cross section of the transverse bar 35 when the movable stop 27 is in the open position.

To disengage the ski boot 25 from the toe piece, it suffices to press on the locking lever 46, using the end of a ski pole, for example. This action causes the release of the control lever 45. Further exertion of force acts on the control lever 45, thereby lifting the central articulation 19 and, therefore, enabling the spacing of the tightening lugs 13*a* and 13*b* from the housings 23*a* and 23*b*. The boot is then released from the toe piece.

Therefore, it can be understood that, due to the movable stop 27, the engagement of a touring ski boot in the toe piece 3 is greatly facilitated.

In addition, it is noted that the present solution is simple and economical, as only one element, namely the movable stop 27 shown in FIG. 3, is added, compared to the known prior art solutions.

The invention has been described by way of a particular embodiment. Other alternative constructions are within the scope of the invention. For example, the toe piece need not have a locking lever 46. The bi-stable elastic mechanism 17 may be different. For example, it may include flexion blades instead of springs 21*a*, 21*b*, or may have more springs. It may have more stable positions. Alternatively, the tightening elements can be continuously biased by an elastic mechanism, with a single stable position, namely the tightening position.

According to another alternative embodiment, the toe piece does not include a bi-stable elastic mechanism supported by the tightening levers. In this case, the switch from a tightening position to an open position is achieved by maneuvering the actuating lever 45. The tightening levers are then much simpler. The movable stop is then in contact with the end of the recumbent arm of each tightening lever.

In the embodiments described above, the lateral housings 23*a*, 23*b* are provided directly in the sole of the boot 25. Alternatively, it is within the scope of the invention to provide these lateral housings 23*a*, 23*b* on an element that is attached, removably or not removably, to the boot. In this case, the lateral housings 23*a*, 23*b* are indirectly provided in the boot 25.

Although the invention provides that the movable stop 27 is affixed to the central articulation 19, the invention extends to other embodiments as long as the movable stop 27 is directly connected to the tightening elements 7*a*, 7*b*. What matters is that the retraction of the movable stop 27 is directly caused by the relative displacement between the tightening elements 7*a*, 7*b*. Thus, the relative displacement between the tightening elements 7*a*, 7*b* causes the movable stop 27 to switch between its active position and its retracted position.

The movable stop can also be split into two portions, each portion being carried by a tightening element.

Alternatively, the invention also applies to other tightening elements. For example, the tightening lugs 13*a*, 13*b* may be brought closer together as a result of a translation of the tightening elements, a deformation of the arms of the tightening elements, a rotation about substantially vertical axes.

According to another embodiment, the movable stop comprises a removable wedge positioned so as to be interposed between the movable stop and the portion of the front end of the boot. Thus, when the stop is in the active position, as the boot is being positioned, the boot comes into contact with the wedge affixed to the stop, which makes it possible to adjust the longitudinal positioning of the lateral housings of the boot in relation to the tightening lugs. This is very useful in the case in which boots are used, for each of which the portion of the front end has specific dimensions, from one model to the next. Thus, simply by changing the removable wedge, the toe piece can be used with various models of footwear while still providing assistance to boot insertion, that is to say, control of the relative longitudinal positioning between the boot and the toe piece, prior to boot insertion.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A toe piece for a gliding apparatus to be used in a gliding sport, the toe piece comprising:

two opposite tightening elements, each of the tightening elements having an area of a respective end carrying a respective tightening lug;

the two tightening elements structured and arranged to be movable, in relation to one another, between two positions comprising:

a boot-tightening position for tightening a front end of a boot, in which the tightening lugs are brought closer together so as to cooperate with corresponding lateral boot housings provided, directly or indirectly, in the boot to form a pivot axis for the boot; and an open position in which the tightening lugs are spaced apart so as to release the boot from the tightening elements;

a stop structured and arranged to be movable between two positions comprising:

an active position, in which the movable stop can engage a portion of the front end of the boot in order to longitudinally position the lateral housings of the boot substantially in an area of the tightening lugs; and a retracted position, in which the movable stop is positioned so as not to interfere with normal pivoting of the boot in an ascent phase of the gliding sport, the movable stop being in an active position when the two tightening elements are in an open position;

the stop being directly connected to the tightening elements, so that a relative displacement between the tightening elements causes the movable stop to switch between the active position and the retracted position.

2. A toe piece according to claim 1, wherein:

the movable stop is structured and arrange to move along a substantially vertical direction.

3. A toe piece according to claim 1, wherein:

the active position of the movable stop is a raised position;

the retracted position of the movable stop is a lowered position.

4. A toe piece according to claim 1, wherein:

each of the two tightening elements forms a lever pivotally articulated about a longitudinal axis;

each of the tightening elements has a respective one end in contact with the movable stop.

5. A toe piece according to claim 1, further comprising:

a bi-stable elastic mechanism;

the movable stop is affixed to the bi-stable elastic mechanism enabling the two tightening elements to tilt between the tightening position and the open position.

6. A toe piece according to claim 5, wherein:

the movable stop is affixed to a central articulation forming an element of the bi-stable elastic mechanism, the central articulation connecting an end of a first of the two tightening elements to an end of a second of the two tightening elements.

7. A toe piece according to claim 6, wherein:

the movable stop comprises:

an upright portion structured and arranged to come into contact, when in the active position, with a portion of the front end of the boot;

a recumbent portion affixed to the central articulation of the bi-stable mechanism.

8. A toe piece according to claim 7, wherein:

the upright portion of the movable stop has a free end comprising a transverse bar;

the transverse bar has opposite ends and an upper surface having a concave shape between the opposite ends.

9. A toe piece according to claim 8, wherein:

the transverse bar is carried by two flanges defining a slot for passage of an actuating lever in engagement with the bi-stable elastic mechanism.

10. A toe piece according to claim 1, further comprising:

an actuating lever having an end forming a fork housing a portion of the movable stop.

11. A toe piece according to claim 1, further comprising:

an actuating lever of the tightening elements;

a locking mechanism for locking the actuating lever.

12. A toe piece according to claim 11, further comprising:

an elastic mechanism for holding the locking mechanism in a configuration for locking the actuating lever, when the lugs are in the tightening position.

13. A toe piece according to claim 1, wherein:

the movable stop is structured and arranged so that, in the active position, the movable stop positions the boot so that the pivot axis of the boot, as defined by the boot housings, is positioned with an offset between 1.0 and 4.0 mm, slightly before the axis defined by the tightening lugs in the tightening position.

14. A toe piece according to claim 1, wherein:

the movable stop comprises a removable wedge positioned so as to be interposed between the movable stop and the portion of the front end the boot.

15. A toe piece according to claim 1, wherein:

the toe piece for a gliding apparatus to be used in a gliding sport is a binding structured and arranged for use with a touring ski for the practice of ski touring, the binding being structured and arranged to affix a forefoot area of a ski boot and for allowing alternate movement of a heel of the ski boot toward and away from the ski during the ascent phase of ski touring.

16. A gliding apparatus equipped with a toe piece according to claim 1.

* * * * *